United States Patent [19]

Wan

[11] Patent Number: 4,966,636

[45] Date of Patent: Oct. 30, 1990

[54] TWO-PHASE HIGH DAMPING CAPACITY F3-MN-AL-C BASED ALLOY

[75] Inventor: Chi-Meen Wan, Hacienda Heights, Calif.

[73] Assignee: Famcy Steel Corporation, Pittsburgh, Pa.

[21] Appl. No.: 341,117

[22] Filed: Apr. 20, 1989

Related U.S. Application Data

[63] Continuation-in-part of Ser. No. 218,695, Jul. 8, 1989, Pat. No. 4,875,933.

[51] Int. Cl.[5] ..... C22C 38/04; C22C 38/06

[52] U.S. Cl. ..... 148/329; 420/74; 420/56

[58] Field of Search ..... 420/72, 79, 74, 56, 420/57, 58; 148/329

[56] References Cited

U.S. PATENT DOCUMENTS

| | | | |
|---|---|---|---|
| 4,398,951 | 8/1983 | Wallwork | 420/79 |
| 4,847,046 | 7/1989 | Kim et al. | 148/329 |
| 4,865,662 | 9/1989 | Zimmer et al. | 148/329 |

FOREIGN PATENT DOCUMENTS

| | | | |
|---|---|---|---|
| 655824 | 1/1963 | Canada | 148/329 |
| 60-248866 | 12/1985 | Japan | 420/72 |

*Primary Examiner*—Deborah Yee

[57] ABSTRACT

Carbon steels and other hot-and cold-workable ferrous alloys generally have poor damping capacity as compared to that cast iron (gray cast iron, malleable cast iron and ductile cast iron). This is because the graphite in cast irons helps to absorb the damping force and depresses the damping wave. But cast iron can not be rolled into strip or sheet.

By controlling the correlated concentrations of manganese, aluminum and carbon, Fe-Mn-Al-C based alloys are made to be $\alpha+\gamma$ two-phase alloy steel with different $\alpha$ and $\gamma$ volume fractions. With particular ferrite volumes, workable Fe-Mn-Al-C based alloys have equivalent and better damping capacity than that of cast irons especially in the high frequency side. Such alloys suppress the vibration noise that comes from machine rooms, motors, air conditioners, and etc. Chromium and other minor amount of elements can be added to this alloy system to improve the corrosion resistance.

14 Claims, 1 Drawing Sheet

TWO-PHASE HIGH DAMPING CAPACITY F3-MN-AL-C BASED ALLOY

The present application is a continuation-in-part of U.S. application Ser. No. 218,695 filed July 8, 1988, which is now U.S. Pat. No. 4,875,933.

BACKGROUND

For the past years $\alpha+\gamma$ two-phase alloy have been developed by adding molybdenum and cobalt to the Fe-Ni-Cr alloy system for the purpose of making alloys having both better stress corrosion and hydrogen embrittlement resistance. But none of these alloys was designed for the purpose of higher damping capacity. The iron based materials that have been using for high damping capacity are cast irons. The graphite in those cast iron is the most important factor for the absorbing of the high frequency vibration wave. But cast irons generally are not workable. Therefore the usage of cast irons in high damping application is limited.

DETAIL DESCRIPTION

In the Fe-Mn-Al-C based alloys manganese and carbon are $\gamma$ phase formers and aluminum is $\alpha$ phase former. By suitable chemical composition arrangement, Fe-Mn-Al-C based alloys can be designed to be full $\gamma$ phase steel such as Fe-29Mn-7Al-1C. Reduction fo the manganese or carbon or both of them and the increase of aluminum can promote the appearance of $\alpha$ phase, and make the alloy an $\alpha+\gamma$ two-phase steel. The volume fraction of $\alpha$ phase can be easily controlled by changing the amount of manganese or/and carbon or/and aluminum or/and some other ferrite former elements.

Alloys according to the invention contain, weight percent, 10% to 45% manganese, 4% to 12% aluminum, up to 12% chromium, 0.01% to 0.7% carbon and the balance essentially iron and are characterized by a microstructure containing about 25 to about 75 volume percent ferrite, with the remainder austenite and by a high damping capacity on the order of that of a cast iron. Some other minor elements such as nickel, molybdenum, columbium, cobalt, silicon, . . . etc. may be further comprised in this alloy.

EXAMPLE 1

This example illustrates the effect of the element compositions on the change of $\alpha$ volume fraction in the Fe-Mn-Al-C based alloys. Manganese and carbon are austenite phase stabilizers and aluminum is a ferrite phase former. The effect of the carbon content on the ferrite fraction of the Fe-Mn-Al-C based alloys is shown in Table I. in which the chemical composition of aluminum and manganese are essentially constant and the carbon content decreases from 0.5 wt % to 0.11 wt %. With the decreasing of carbon content, the ferrite phase volume fractions of the alloys increase from 0% to 36%. With the change of manganese, carbon and aluminum contents, the volume fractions of ferrite phase and balanced $\gamma$ phase is controlled to be from 25% to 75%.

Within this ferrite fraction range, excellent damping capacity is always found in the Fe-Mn-Al-C based alloy.

TABLE I

| | composition | | | |
|---|---|---|---|---|
| alloy # | Mn (wt %) | Al (wt %) | C (wt %) | ferrite vol % |
| 1 | 26.0 | 7.4 | 0.5 | 0 |
| 2 | 26.3 | 7.6 | 0.34 | 11.9 |
| 3 | 25.8 | 7.4 | 0.11 | 36.0 |

EXAMPLE 2

Figure 1:
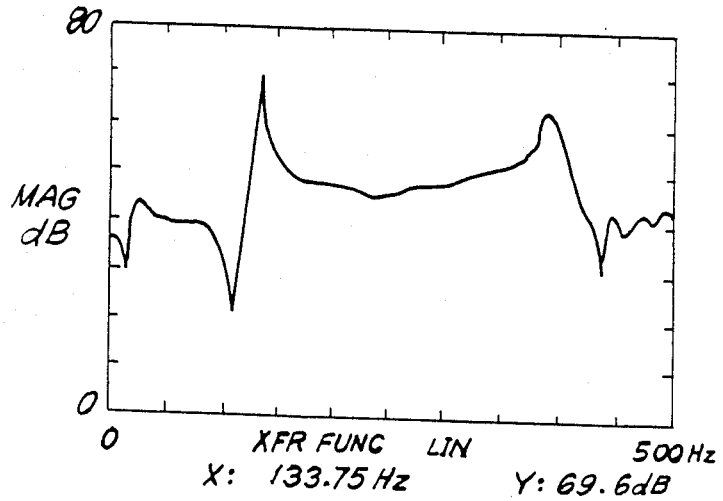
FIG. 1 depicts the damping capacity curve for an alloy of the invention.
Figure 2:
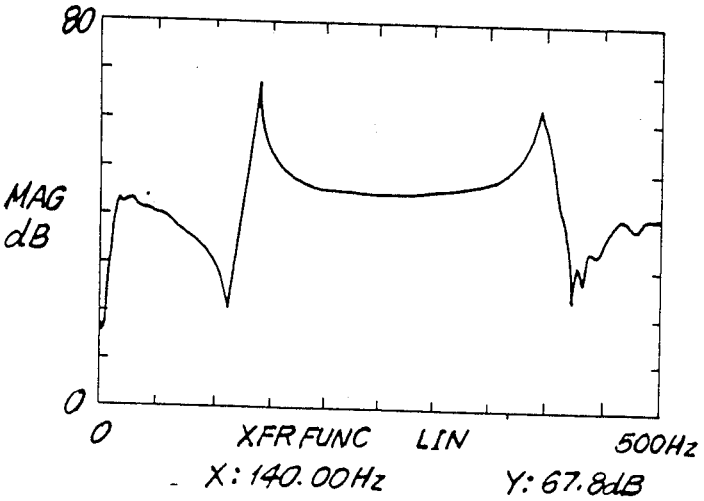
FIG. 2 depicts the damping capacity curve for ductile iron.

The example illustrates the good damping capacity fo the said $\alpha+\gamma$ two-phase Fe-Mn-Al-C based alloys which have been measured and determined with comparison to ductile cast iron. The test sample of the invention contained 19.7Mn-5.84Al-5.74Cr-0.19C. The ferrite volume fraction is about 65% balanced with $\gamma$ phase. The damping capacity curves of the damping capacity tests of the Fe-Mn-Al-C based alloy and ductile cast iron are shown in FIG. 1 and FIG. 2. It is seen that the damping capacities of the two alloys are almost equivalent.

EXAMPLE 3

This example illustrates the good workability of $\alpha+\gamma$ two-phase Fe-Mn-Al-C based alloys. The alloys listed in Table II were cast into ingot; homogenized at 1200° C.; cut and hot forged at 1200° C.; further annealed at 1150° C. and descaled. The alloys were cold rolled into 2.0 mm thick strip and annealed. The ferrite volume percentages of these strips were measured and are listed in Table III. The mechanical properties of these annealed strips are also listed in Table III. It is seen that the alloys of the invention have good workability and excellent mechanical properties.

TABLE II

| alloy no. | Mn | Al | C | Cr | Other |
|---|---|---|---|---|---|
| #109 | 25.1 | 6.7 | 0.287 | 5.6 | 200 ppm$N_2$ |
| #108 | 30.3 | 6.3 | 0.244 | 5.8 | — |
| #320 | 21.6 | 6.8 | 0.11 | 0 | — |
| #317 | 20.0 | 6.1 | 0.4 | 5.5 | 0.92 Mo |
| #129 | 33.4 | 10.3 | 0.47 | 2.1 | 0.2 Ti |
| #116 | 29.5 | 10.2 | 0.4 | 0 | 0.1 Nb |

TABLE III

| sample no. | 0.2% proof stress (ksi) | ultimate tensile stress (ksi) | % elongation | hardness (Rb) | ferrite % |
|---|---|---|---|---|---|
| #109 | 45 | 103 | 42 | 84 | 45 |
| #108 | 39 | 94 | 44 | 80 | 28 |
| #320 | 41 | 98 | 43 | 82 | 67 |
| #317 | 44 | 101 | 41 | 83 | 75 |
| #129 | 61 | 112 | 38 | 86 | 65 |
| #116 | 59 | 109 | 37 | 85 | 73 |

What is claimed is:

1. A ferrite-austenite two-phase alloy (of high damping capacity) having a composition consisting essentially of 10 to 45 wt % manganese, 4 to 15 wt % aluminum, up to 12 wt % chromium, 0.01 to 0.7 wt % carbon and the balance essentially iron, with the ferrite phase of said alloy having about 25% to 75% by volume, the remainder being essentially austenite, said alloy having a damping capacity of about the same level as that of ductile iron.

2. The alloy of claim 1 containing 0 to 4.0 wt % molybdenum.

3. The alloy of claim 1 containing 0 to 4.0 wt % copper.

4. The alloy of claim 1 containing 0 to 2.0 wt % nickel.

5. The alloy of claim 1 containing 0 to 3.5 wt % niobium.

6. The alloy of claim 1 containing up to 500 ppm boron.

7. The alloy of claim 1 containing up to 0.2 wt % nitrogen.

8. The alloy of claim 1 containing 0 to 3.5 wt % titanium.

9. The alloy fo claim 1 containing 0 to 2.0 wt % cobalt.

10. The alloy of claim 1 containing 0 to 3.5 wt % vanadium.

11. The alloy of claim 1 containing 0 to 3.5 wt % tungsten.

12. The alloy of claim 1 containing 0 to 2.0 wt % zirconium.

13. The alloy claim 1 containing up to 2.5 wt % silicon.

14. A ferrite-austenite two-phase alloy of high damping capacity having a composition consisting essentially of 20% to 33.4% manganese, 6.1% to 10.3% aluminum, 0.11% to 0.47% carbon, 0 to 5.8% chromium, 0 to 200 ppm nitrogen, 0 to 0.92% molybdenum, 0 to 0.2% titanium, 0 to 0.1% niobium and the balance essentially iron, with the ferrite phase of said alloy being about 28% to 75% by volume, the remainder of the microstructure being essentially austenite.

* * * * *